US009677387B2

(12) United States Patent
Yhuel et al.

(10) Patent No.: US 9,677,387 B2
(45) Date of Patent: Jun. 13, 2017

(54) SCREEN ASSEMBLY

(71) Applicant: Schlumberger Technology Corporation, Sugar Land, TX (US)

(72) Inventors: Bernard Yhuel, Pau (FR); Philippe Gambier, Houston, TX (US); Gilles H. Dessoulavy, Houston, TX (US); Ezio Toffanin, Stavanger (NO); Merrick Walford, Lons (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 647 days.

(21) Appl. No.: 13/707,011

(22) Filed: Dec. 6, 2012

(65) Prior Publication Data

US 2013/0220606 A1 Aug. 29, 2013

(30) Foreign Application Priority Data

Feb. 23, 2012 (EP) ..... 12290060

(51) Int. Cl.
*E21B 43/10* (2006.01)
*E21B 43/08* (2006.01)
*E21B 43/04* (2006.01)

(52) U.S. Cl.
CPC ..... *E21B 43/108* (2013.01); *E21B 43/04* (2013.01); *E21B 43/08* (2013.01); *E21B 43/088* (2013.01); *E21B 43/103* (2013.01)

(58) Field of Classification Search
CPC .... E21B 43/103; E21B 43/105; E21B 43/106; E21B 43/108; E21B 43/088
See application file for complete search history.

(56) References Cited

U.S. PATENT DOCUMENTS 4,260,016 A 4/1981 Calderon
4,421,165 A * 12/1983 Szarka ..... E21B 33/127 166/151
5,327,962 A * 7/1994 Head ..... E21B 33/1277 166/187
5,390,966 A 2/1995 Cox et al.
5,515,915 A 5/1996 Jones et al.
5,588,487 A 12/1996 Bryant
(Continued)

FOREIGN PATENT DOCUMENTS

EP 2287442 2/2011
EP 2287443 2/2011
(Continued)

OTHER PUBLICATIONS

Search Report for corresponding EP Application No. 12290060.8 on Jul. 11, 2012, 5 pages.
(Continued)

*Primary Examiner* — Blake Michener
(74) *Attorney, Agent, or Firm* — Jeffrey R. Peterson

(57) ABSTRACT

An assembly that is usable with a well includes a base pipe, a shroud that is disposed radially outside of the base pipe and tubes. The tubes are disposed radially outside of the base pipe and are radially inside the shroud. The tubes longitudinally extend along the base pipe and radially expand to radially expand the shroud in response to pressurization of the tubes.

16 Claims, 6 Drawing Sheets

(56) References Cited

U.S. PATENT DOCUMENTS 5,695,008 A * 12/1997 Bertet ..... D04C 1/06 166/187
5,868,200 A 2/1999 Bryant et al.
5,890,533 A 4/1999 Jones
6,457,518 B1 10/2002 Castano-Mears et al.
6,510,896 B2 1/2003 Bode et al.
6,530,574 B1 * 3/2003 Bailey ..... E21B 33/1208 166/179
6,640,893 B1 * 11/2003 Rummel ..... E21B 33/1208 166/187
6,752,207 B2 6/2004 Danos et al.
7,036,600 B2 * 5/2006 Johnson ..... E21B 43/105 166/207
7,306,033 B2 * 12/2007 Gorrara ..... E21B 33/127 166/187
7,357,189 B2 * 4/2008 Aldaz ..... E21B 33/1246 166/187
7,493,959 B2 2/2009 Johnson et al.
7,562,709 B2 7/2009 Saebi et al.
7,591,321 B2 * 9/2009 Whitsitt ..... E21B 33/1272 166/187
7,661,476 B2 2/2010 Yeh et al.
7,828,056 B2 11/2010 Dybevik et al.
7,841,409 B2 11/2010 Gano et al.
7,866,708 B2 1/2011 Johnson et al.
7,938,184 B2 5/2011 Yeh et al.
7,971,642 B2 7/2011 Yeh et al.
8,011,437 B2 9/2011 Yeh et al.
8,555,985 B2 * 10/2013 Metcalfe ..... E21B 33/1277 166/228
2002/0088744 A1 7/2002 Echols et al.
2002/0092654 A1 * 7/2002 Coronado ..... E21B 33/1208 166/369
2002/0125006 A1 9/2002 Hailey
2003/0000700 A1 1/2003 Hailey
2003/0000875 A1 * 1/2003 Echols ..... E21B 19/22 210/85
2003/0029614 A1 * 2/2003 Michel ..... E21B 43/04 166/278
2004/0007829 A1 * 1/2004 Ross ..... E21B 33/1208 277/626
2004/0020660 A1 * 2/2004 Johnson ..... E21B 43/105 166/384
2004/0238168 A1 12/2004 Echols
2005/0016740 A1 * 1/2005 Aldaz ..... E21B 33/1246 166/387
2005/0109517 A1 5/2005 Spray
2005/0155773 A1 7/2005 Wetzel et al.
2005/0199401 A1 * 9/2005 Patel ..... E21B 33/1277 166/387
2006/0042801 A1 * 3/2006 Hackworth ..... E21B 29/10 166/387
2007/0084608 A1 4/2007 Bixenman et al.
2007/0089909 A1 4/2007 Freeman
2008/0066900 A1 * 3/2008 Saebi ..... E21B 43/04 166/51
2008/0289815 A1 11/2008 Moen et al.
2010/0038076 A1 * 2/2010 Spray ..... E21B 43/103 166/207
2010/0051270 A1 3/2010 Dusterhoft et al.
2010/0175895 A1 7/2010 Metcalfe
2010/0186969 A1 * 7/2010 Metcalfe ..... E21B 33/1277 166/382
2011/0083860 A1 * 4/2011 Gano ..... E21B 43/12 166/386
2013/0341005 A1 * 12/2013 Bruce ..... E21B 33/1277 166/207
2015/0027726 A1 * 1/2015 Bruce ..... E21B 33/1208 166/373
2015/0204168 A1 * 7/2015 Greci ..... E21B 43/08 166/230
2016/0024897 A1 * 1/2016 Greci ..... E21B 43/103 166/296

FOREIGN PATENT DOCUMENTS

GB 2404683 2/2005
GB 2492193 6/2013
WO WO2009001069 12/2008
WO WO2009001073 12/2008
WO WO2012066290 5/2012
WO WO2012135587 10/2012
WO WO2013132254 9/2013
WO WO2013186569 12/2013

OTHER PUBLICATIONS

Third Party Observation for corresponding EP Application No. 13751724.9, Jan. 10, 2014, 4 pages.
EP Application No. 13751724.9 Supplementary EP Search Report, dated Jun. 21, 2016, 4 pgs.
Third Party Observation submitted Jan. 10, 2014 for International Patent Application No. PCT/US2013/025501, filed Feb. 11, 2013, 4 pages total.
Kumar et al., "Design Optimization of Slotted Liner Completions in Horizontal Wells of Mumbai High Field," SPE 13321, SPE Asia Pacific Oil & Gas Conference and Exhibition, Brisbane, Queensland, AU, Oct. 18-20, 2010, 8 pages.
International Search Report and Written Opinion mailed May 15, 2013 for International Patent Application No. PCT/US2013/025501, 9 pages.

* cited by examiner

SCREEN ASSEMBLY

This application claims the benefit of European Patent Application No. 12290060.8, which was filed on Feb. 23, 2012.

BACKGROUND

A fluid producing well may extend into one or more subterranean formations that contain unconsolidated particulates, often referred to as "sand," which may migrate out of the formations with the produced oil, gas, water, or other fluid. If appropriate measures are not undertaken, the sand may abrade the well and surface equipment, such as tubing, pumps and valves. Moreover, if appropriate measures are not undertaken, the sand may partially or fully clog the well, inhibit fluid production, and so forth.

For purposes of controlling the sand production in a given zone, or stage, of a production well, a tubing string that communicates produced fluid from the well may contain a screen that is positioned in the stage. The screen may contain filtering media through which the produced fluid flows into the tubing string and which therefore inhibits sand from entering the inside of the tubing string. As another measure to control sand production, in the completion of the well, a gravel packing operation may be performed for purposes of depositing a gravel pack around the periphery of the screen. The gravel pack serves as a filtering substrate to allow produced well fluid to enter the tubing string and prevent sand from entering the tubing string. The gravel pack also serves to stabilize the wellbore.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

In accordance with an example implementation, an assembly includes a base pipe, a filtering media disposed outside of the base pipe, a shroud disposed outside of the base pipe and tubes. The tubes are disposed between the filtering media and the shroud and longitudinally extend along the base pipe. The tubes are adapted to be pressurized to cause the tubes to radially expand to radially expand the shroud.

In accordance with another example implementation, a technique includes running an assembly including a base pipe, a shroud outside of the base pipe and tubes disposed between the base pipe and the shroud in the well; and expanding the shroud by pressurizing the tubes.

In accordance with yet another example implementation, a system includes a string and screen assemblies. At least one of the screen assemblies includes a base pipe, a filtering media disposed outside of the base pipe, a shroud disposed outside of the base pipe and tubes. The tubes are disposed between the filtering media and the shroud and longitudinally extend along the base pipe. The tubes are adapted to be pressurized to cause the tubes to radially expand to radially expand the shroud.

Advantages and other features will become apparent from the following drawings, description and claims.

DETAILED DESCRIPTION

In the following description, numerous details are set forth to provide an understanding of features of various embodiments. However, it will be understood by those skilled in the art that the subject matter that is set forth in the claims may be practiced without these details and that numerous variations or modifications from the described embodiments are possible.

As used herein, terms, such as "up" and "down"; "upper" and "lower"; "upwardly" and downwardly"; "upstream" and "downstream"; "above" and "below"; and other like terms indicating relative positions above or below a given point or element are used in this description to more clearly describe some embodiments. However, when applied to equipment and methods for use in environments that are deviated or horizontal, such terms may refer to a left to right, right to left, or other relationship as appropriate.

In general, systems and techniques are disclosed herein for purposes of completing a given zone, segment, or stage, of a well in a process that includes running a screen assembly in a radially unexpanded state into the stage; pressurizing longitudinally-extending tubes inside a shroud of the screen assembly to radially expand the shroud; and installing a gravel pack inside the shroud. As disclosed herein, in accordance with example implementations, in connection with installing the gravel pack inside the shroud, a gravel-laden slurry is communicated through the shroud expanding tubes such that the tubes are also used as gravel packing shunt tubes; and due to the pressure involved with the communication of the slurry, the tubes radially expand to therefore, radially expand the shroud. Therefore, at the conclusion of the gravel packing operation, the interior of the tubes contain gravel, which provides structural support to retain the tubes and shroud in their radially expanded states. Moreover, the introduction of the gravel pack inside the shroud provides structural support to maintain the shroud in its radially expanded state, as well as provide a filtering substrate to inhibit, if not prevent, formation sand from entering production tubing. As disclosed herein, in further example implementations, separate gravel packing shunt tubes may be used, in lieu of the shroud expanding tubes, to deliver the gravel inside the shroud.

Figure 1:
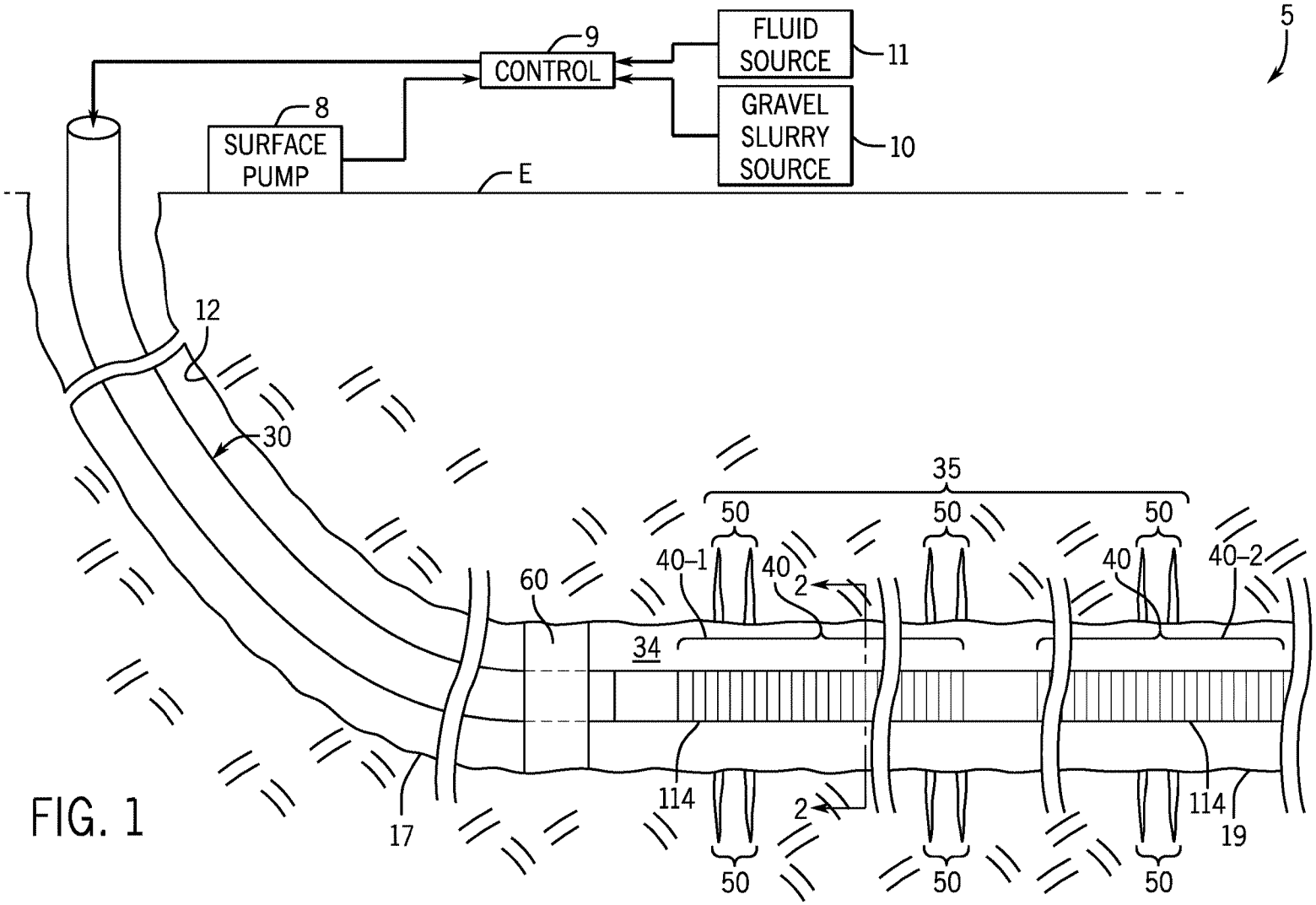
FIG. 1 is a schematic diagram of a well system illustrating screen assemblies of the system in unexpanded states according to an example implementation.

Referring to FIG. 1, as a more specific example, in accordance with some implementations, a well system 5 includes a wellbore 12 that may traverse one or more producing formations (as an example). In general, the wellbore 12 extends for this example from a heel end 17 to a toe end 19 through one or multiple stages, or zones, of the wellbore 12. The well system 5 may have additional wellbores, including lateral wellbores, deviated wellbores and/or vertical wellbores, in accordance with further implementations; as the sole wellbore 12 is depicted for simplicity for purposes of clarifying the use and installation of an example completion.

For the example of FIG. 1, the wellbore 12 extends into a particular example zone, or stage 35; and the wellbore 12 is uncased, or is an open hole wellbore. It is noted that the system 5 is merely an example, in that the stage 35 (and wellbore 12) may be cased, in accordance with further implementations. As also depicted in FIG. 1, in accordance with an example implementation, the stage 35 has been perforated to form various sets of perforation tunnels 50. In this regard, one or more perforating guns may have been previously deployed in the wellbore 12 within the stage 35; and shaped charges of these guns may have been fired at various locations to form perforation jets to form corresponding perforation tunnels 50 into the surrounding formation(s).

It is noted that in accordance with further implementations, hydraulic communication with the formation may be enhanced in other ways. For example, in accordance with further implementations, an abrasive jetting tool may have been previously deployed in the wellbore 12 for purposes of enhancing fluid communication. Moreover, in accordance with further implementations, the wellbore 12 may be formed by drilling and no further operations may be performed to further enhance hydraulic communication with the formation(s). Thus, many variations are contemplated, which are within the scope of the appended claims.

As depicted in FIG. 1, a tubing string 30 extends downhole into the wellbore 12 and contains screen assemblies 40 (screen assembly 40-1 and 40-2, being depicted as specific examples in FIG. 1), which are serially connected together. For this example, uphole from the uppermost screen assembly 40-1, the tubing string 30 may contain at least one packer 60, which is set (i.e., radially expanded) to form an annular seal between the exterior of the tubing string 30 and the borehole wall. In accordance with example implementations, the packer 60 is initially unset (i.e., radially retracted) when the tubing string 30 is deployed in the wellbore 12 and thereafter set to form the annular seal between the tubing string 30 and the borehole wall. In general, the packer 60 may be one of numerous different types of packers, such as a weight-set packer, a hydraulically-set packer, a mechanically-set packer, an inflatable packer, a swellable packer, and so forth.

FIG. 1 generally depicts an intermediate state of a completion process in which the screen assemblies 40 are radially retracted, i.e., have respective collapsed, or radially unexpanded, run-in-hole states that facilitate the running of the screen assemblies 40 (and tubing string 30) into the wellbore 12. As described herein, once in position downhole, the screen assemblies 40 may be radially expanded into a surrounding annular space 34 between the borehole wall and the shroud 114 so that the shrouds 114 generally conform to the borehole wall. As separate from or part of this expansion process (as further disclosed herein), a gravel pack may be introduced inside the screen assemblies 40 for purposes of providing a sand filtering substrate inside shrouds 114, as well as providing structural support to maintain the shrouds 114 in their radially expanded states.

For purposes of gravel packing and/or expanding of the screen assemblies 40, the well system 5 includes various surface equipment components that are disposed at the Earth surface E. In this regard, as a simplified example, the well system 5 may include a fluid source 11, a gravel slurry source 10, various controls 9 (valves, for example) and a surface pump 8, which communicate with the well annulus and central passageway of the tubing string 30, as appropriate.

Figure 2:
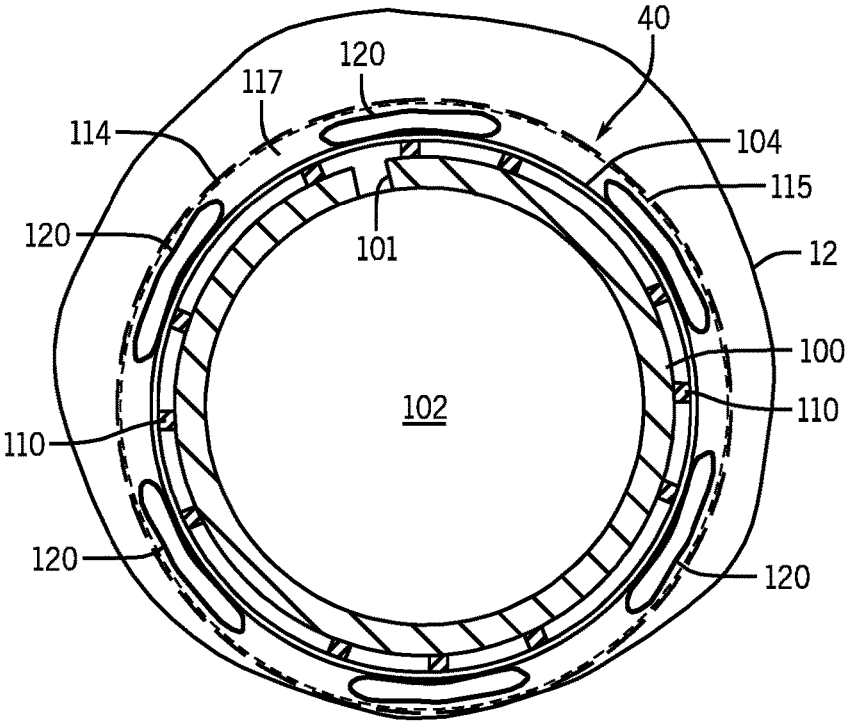
FIG. 2 is a cross-sectional view taken along line 2-2 of FIG. 1 according to an example implementation.

Referring to FIG. 2 in conjunction with FIG. 1, in accordance with an example implementation, the screen assembly 40 includes an interior base pipe 100, which has a central passageway 102 for purposes of communicating produced fluid from the stage 35. For this example, the base pipe 100 is a perforated base pipe, which has various perforations, or openings 101 (one opening 101 being depicted in the cross-sectional view of FIG. 2), which, in general, receive produced well fluid so that the well fluid may be communicated via the central passageway 102 to the Earth surface E. The base pipe 100 may have various other constructions, in accordance with further implementations. For example, in accordance with a further implementation, the base pipe 100 may be a solid pipe that has radial openings such that the fluid communication through each of these openings or groups of the openings may be controlled using an associated intelligent completion device (ICD). Thus, many variations are contemplated, which are within the scope of the appended claims.

For purposes of protecting the components of the screen assembly 40, the assembly 40 includes the outer, protective shroud 114 that circumscribes the base pipe 100, as depicted in FIG. 2. The shroud 114 further closely circumscribes an outer filtering media 115, in accordance with an example implementation. In accordance with some implementations, the outer filtering media 115 is a screen mesh, with openings that are sized to prevent formation sand from entering inside an annular space 117 between the outer filtering media 115 and the base pipe 100.

The screen assembly 40 further includes a second, inner filtering media 104, which closely circumscribes the base pipe 100. The annular space 117 between the outer filtering media 115 and inner filtering media 104 may be gravel packed, as further disclosed herein. The inner filtering media 104 may be a wire-wrapped screen, in accordance with example implementations, which has openings that are sized to prevent the gravel pack material from passing through the inner filtering media 104 and through the openings 101 of the base pipe 100. Thus, in accordance with example implementations, the inner 104 and outer 115 filtering media have two differently-sized openings: the outer filtering media 115 has relatively smaller openings that are sized to prevent formation sand production (and consequently, also retain the larger size gravel pack); and the inner filtering media 104 has relatively larger openings that are sized to retain the gravel pack.

As illustrated in FIG. 2, in accordance with example implementations, longitudinally-extending wires, or "ribs" 110, are radially disposed between the exterior of the base pipe 100 and the interior of the inner filtering media 104 and, in general, are peripherally distributed about the base pipe 100. The ribs 110, in general, provide radial, structural support for the inner filtering media 104.

In accordance with example implementations, the screen assembly 40 further includes the longitudinally-extending shroud expanding tubes 120, which are distributed around the periphery of the base pipe 100 inside the annular space 117 between the inner 104 and outer 115 filtering media. As depicted in FIG. 2, when the screen assembly 40 is run into the well, the tubes 120 are each in a radially unexpanded state, or "collapsed."

In general, the shroud expanding tube 120 may be formed from a material that deforms relatively easily without cracking, such as a 316L alloy, as an example. Other materials may be used for the shroud expanding tube, in accordance with further implementations. In accordance with some implementations, the tube 120 may be constructed from a memory form metal.

Figure 4:
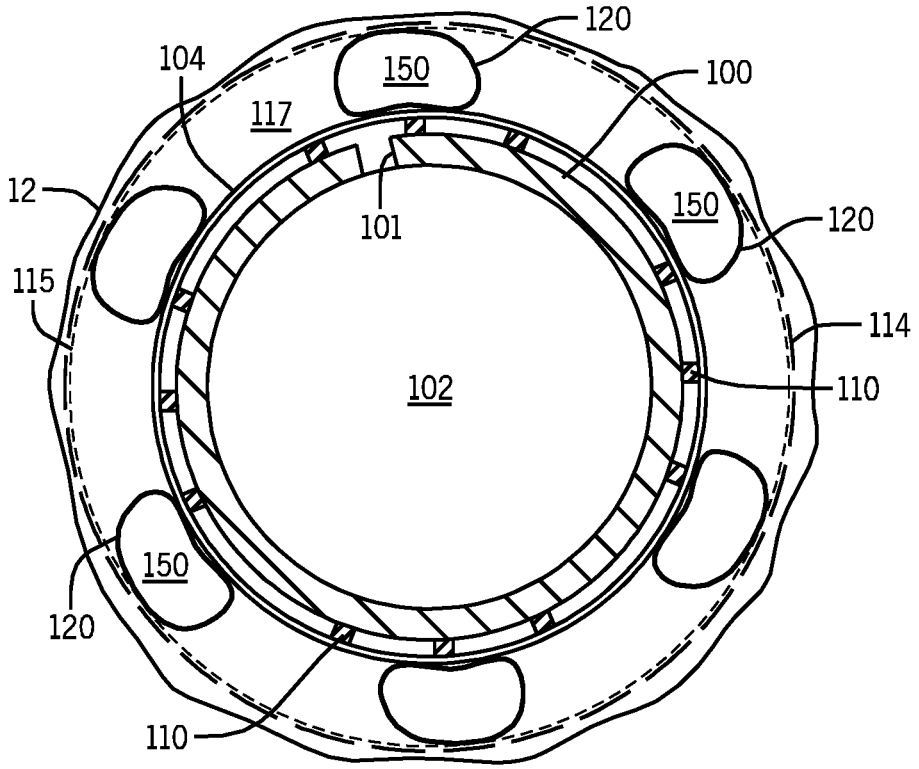
FIG. 4 is a cross-sectional view of the system of FIG. 1 illustrating a radially expanded state of a screen assembly according to an example implementation.

Referring to FIG. 4, after the screen assembly 40 is in the appropriate downhole position, interior spaces 150 of the tubes 120 may be pressurized, which causes corresponding radial expansion of the tubes 120 and shroud 114. Thus, as depicted in FIG. 4, in the radially expanded state, each shroud 114 generally contacts and conforms to the borehole wall.

Figure 5:
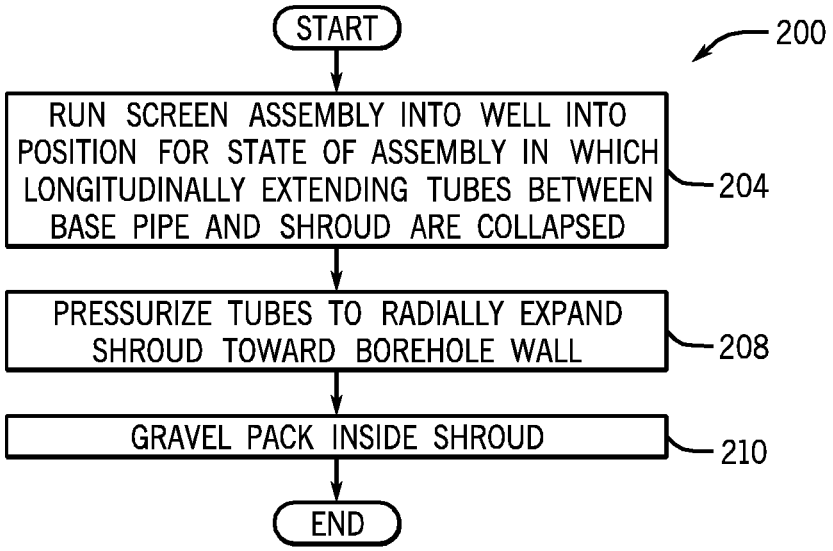
FIGS. 5 and 9 are flow diagrams depicting techniques to complete a segment of a well according to example implementations.

Referring to FIG. 5, using the screen assembly 40, a technique 200 may be used to complete a particular zone, or segment, of a well, in accordance with example implementations. Pursuant to the technique 200, a screen assembly is run into position in a well for a state of the assembly in which longitudinally-extending tubes between a base pipe of the assembly and a shroud of the assembly are collapsed, pursuant to block 204. The tubes are pressurized, pursuant to block 208, to radially expand the shroud toward (against, for example) the borehole wall. A gravel pack may be installed inside the shroud, pursuant to block 210.

Figure 3A:
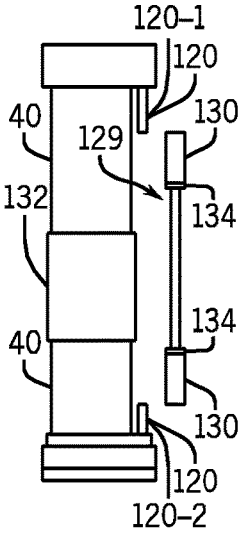
FIGS. 3A, 3B, 3C and 3D illustrate a system and technique to connect shroud expanding tubes of assemblies of the system of FIG. 1 together according to an example implementation.

Referring to FIG. 3A, in accordance with an example implementation, the shroud expanding tubes 120 of adjacent screen assemblies 40 may be connected together using jumper tube assemblies 129. In this regard, for the example of FIG. 3A, the base pipes 100 of two adjacent screen assemblies 40 are connected together via a connector 132. The adjacent screen assemblies 40 have corresponding shroud-expanding tubes 120-1 and 120-2, for this example, which are coupled together using a jumper tube assembly 129.

Figure 3B:
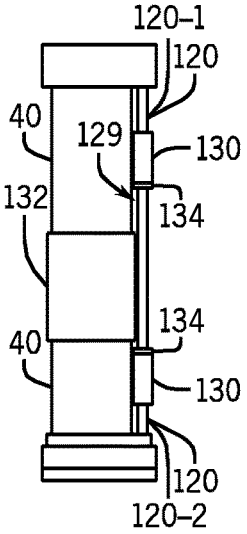
Figure 3C:
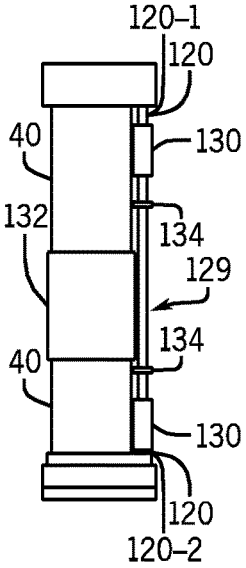
Figure 3D:
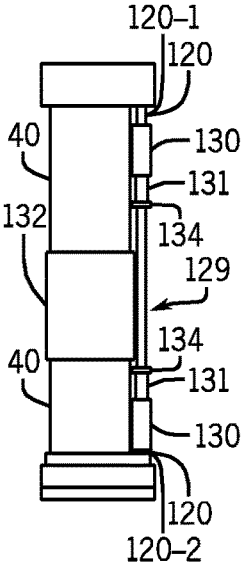

More specifically, in accordance with example implementations, the shroud expanding tubes 120 may be coupled together using jumper tube assemblies 129. Each jumper tube assembly 129 has associated connectors 130 on either end for purposes of forming a sealed connection between an end of a shroud expanding tube 120 and the corresponding end of the jumper tube assembly 129. Before installation, the longitudinal travel of the connector 130 is limited by a clip stop 134. Thus, referring to FIG. 3B, in the process to connect two jumper tube assemblies 129 together, the jumper tube assembly 129 is aligned with the tubes 120-1 and 120-2, so that the connectors 130 may be slid into position to couple the jumper tube 129 to the tubes 120-1 and 120-2 and slid into position, as depicted in FIG. 3C. As depicted in FIG. 3D, snap-on clips 131 may be subsequently installed for purposes of "locking," the connectors 130 in position. Thus, shroud expanding tubes 120 from multiple screen assemblies 40 may be connected together to form a continuous longitudinally extending tube along several screen assemblies 40.

Figure 6:
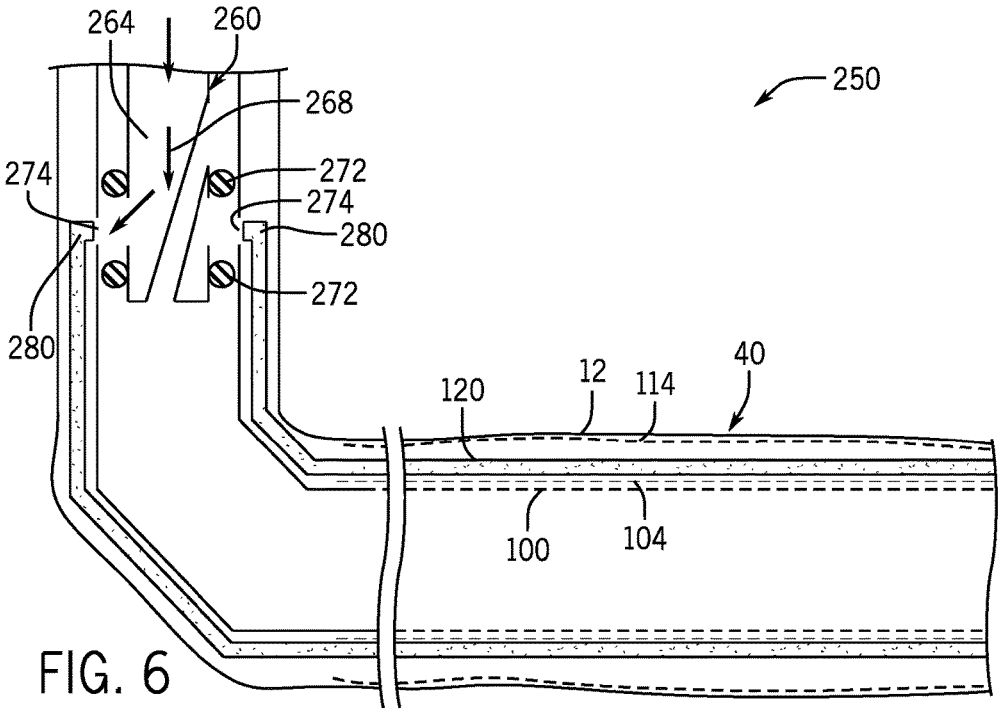
FIG. 6 is a schematic diagram of a well system illustrating pressurization of shroud expanding tubes of a screen assembly according to an example implementation.

The shroud expanding tubes 20 may be pressurized used one of numerous mechanisms, depending on the particular implementation. As an example, FIG. 6 depicts a system 250 for expanding the tubes 120, in accordance with an example implementation. For this implementation, the shroud expanding tube 120 has a corresponding upper port 274, which is constructed to align with a corresponding port of a tool 260 that is deployed inside the tubing string 30. In this regard, when properly aligned, the ports of the tool 260 align with the ports 280 and are sealed via o-rings 272. A fluid flow may be communicated downhole through a passageway 264 of the tool 260 and into the tubes 120 for purposes of pressurizing the interiors of the tubes 120 to radially expand the tubes 120.

Figure 7:
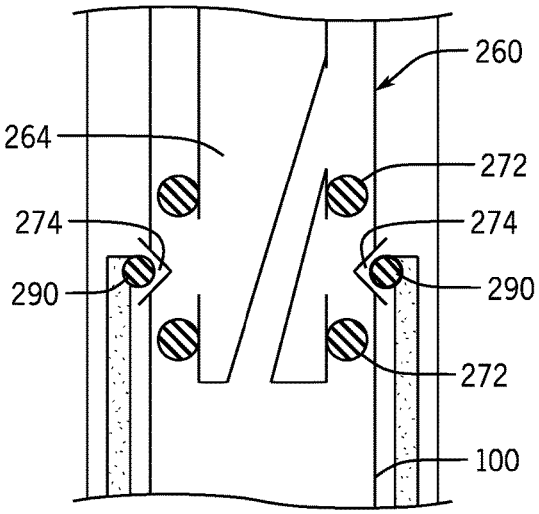
FIG. 7 is a schematic diagram illustrating the use of check valves to maintain shroud expanding tubes in radially expanded states according to an example implementation.
Figure 8:
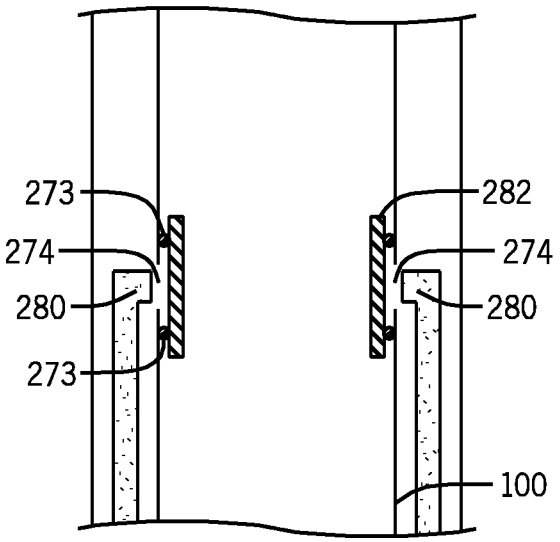
FIG. 8 is a cross-sectional schematic view of a well system illustrating the use of a sliding sleeve valve to maintain shroud expanding tubes in radially expanded states according to an example implementation.

In accordance with example implementations, measures are undertaken for purposes of maintaining the fluid pressurizations of the shroud expanding tubes 120 to retain the shroud 114 in its radially expanded position. For example, referring to FIG. 7, in accordance with an example implementation, check valves 290 may be used on the ports 274 for purposes of allowing the interiors of the shroud expanding tubes 120 to be pressurized and thereafter, preventing outflow of the pressurized fluid to maintain the internal fluid pressure of the shroud expanding tubes 120. As another example, FIG. 8 depicts a system in which a sliding sleeve valve of the tubing string 30 may be used for purposes of maintaining the pressurized states of the tubes 120. In this regard, the sliding sleeve valve, for this example, includes an actuator (not shown) and a sleeve 282, which is sealed via o-rings 273 and which may be actuated (using a shifting tool, for example) for purposes of opening communication with the ports 274 to allow the shroud expanding tubes 120 to be pressurized and thereafter permitting the closure of the ports 274 to retain the fluid pressure. Other mechanisms may be used to maintain the tubes 120 in their pressurized states, in accordance with further implementations.

In further implementations, the gravel packing operation, which is used to install the gravel pack inside the annular space 117 of the shroud 114, may be used for the dual purpose of radially expanding the shroud expanding tubes 120. In this regard, for these implementations, a gravel-laden slurry may be communicated downhole through the passageway of the shroud expanding tubes 120, which for this implementation, also serve as shunt tubes for the gravel packing. Moreover, for this implementation, at the conclusion of the gravel packing operation, the deposited gravel pack inside the shroud expanding tubes 120 retains the tubes 120 in their radially expanded states, thereby obviating the need to maintain fluid pressure on the interior spaces of the tubes 120.

Figure 9:
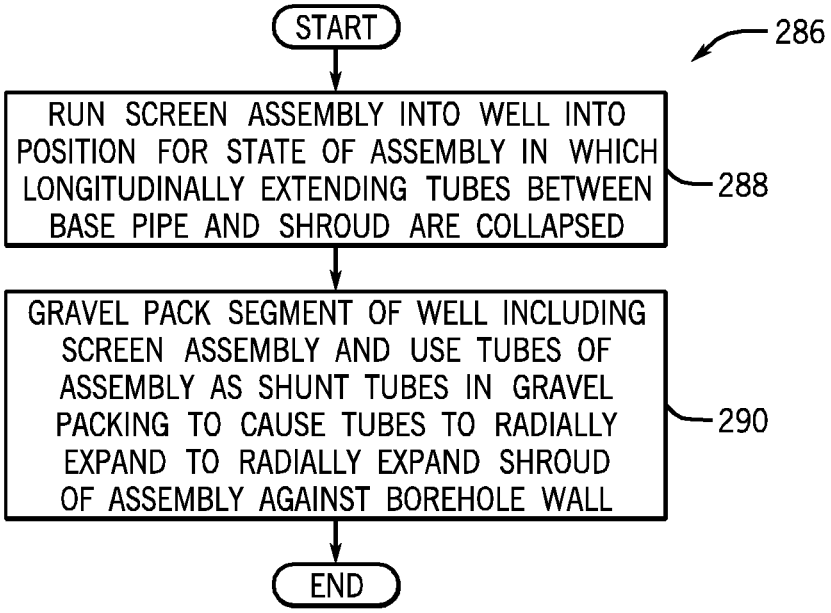

Thus, referring to FIG. 9, in accordance with further implementations, a technique 286 to complete a segment of a well includes running a screen assembly into a well into position for a state of the assembly in which longitudinally-extending tubes between a base pipe of the screen assembly and a shroud of the assembly are collapsed, pursuant to block 288 and thereafter, a segment of the well may be gravel packed (block 290). This gravel packing includes using the longitudinally-extending tubes of the screen assembly as shunt tubes to cause the tubes to radially expand to radially expand the shroud of the assembly against the borehole wall.

Figure 10:
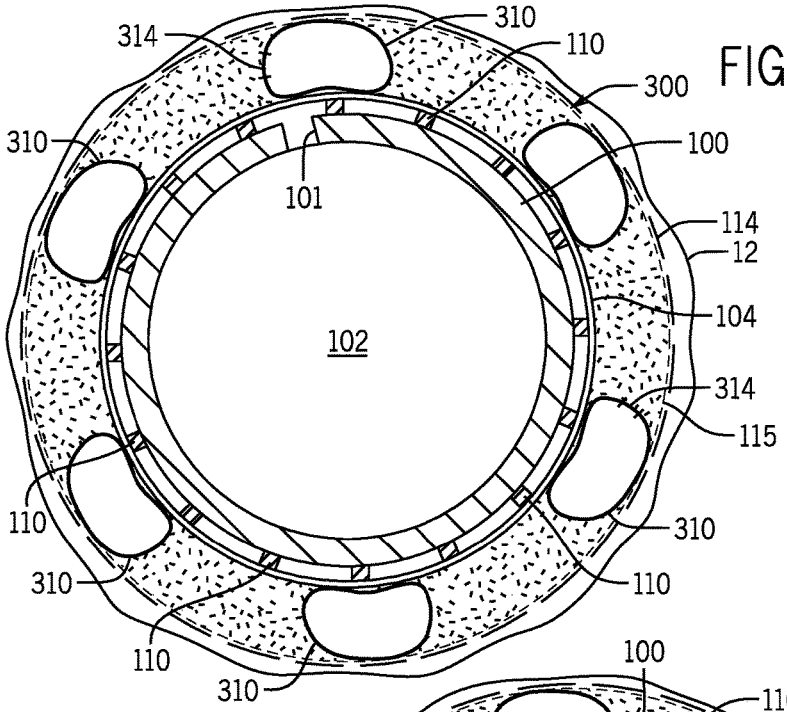
FIG. 10 is a schematic cross-sectional view of a screen assembly illustrating the use of a gravel packing operation to expand the shroud expanding tubes of the assembly according to an example implementation.

As a more specific example, FIG. 10 depicts a screen assembly 300 in accordance with an example implementation. In general, the screen assembly 300 contains components similar to the screen assembly 40 depicted in FIGS. 2 and 4, with similar reference numerals being used to denote similar components. Unlike the screen assembly 40, however, the screen assembly 300 includes longitudinally extending shroud-expanding tubes 310 (replacing the tubes 120). The shroud expanding tubes 310 contain rupture discs 314 for purposes of allowing the tubes 310 to be used as both tubes to communicate the gravel laden slurry into the annular space 117 and serve to radially expand the tubes 310 to expand the shroud 114.

In this regard, each shroud expanding tube 310, in accordance with example implementations, includes longitudinally and radially distributed ports containing rupture discs 314, which are constructed to be breached, or burst, at pressures that exceed the pressures for radially expanding the tubes 310. Therefore, during a first phase, the screen assembly 300 radially expands due to the communication and pressurization inside the tubes 310 due to the communication of the gravel laden slurry inside the tubes 310. Eventually, the pressures in the shroud expanding tubes 310 build until the rupture discs 314 burst, or are breached, which allows the gravel slurry to be introduced into the annular space 117 inside the shroud 114 between/surrounding the tubes 310. The excess fluid returns through the central passageway 102 of the base pipe 100 to the Earth surface E, leaving the gravel pack inside the shroud expanding tubes and outside of the shroud expanding 120 inside the annular space of the shroud 114. After the completion of the gravel packing operation, the gravel inside the tubes 310 provide structural integrity to retain the tubes 310 in their radially expanded states, as well as provide an additional filtering substrate to prevent or at least inhibit the production of formation sand.

Figure 11:
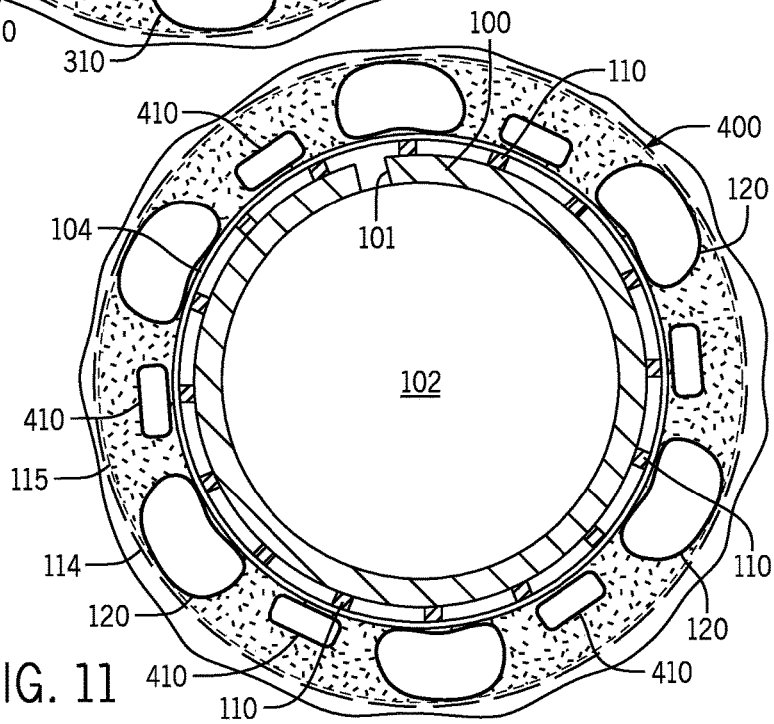
FIG. 11 is a schematic cross-sectional view of a screen assembly illustrating the use of shunt tubes of the assembly to gravel pack an annular region inside a shroud of the assembly according to an example implementation.

Other variations are contemplated, which are within the scope of the appended claims. For example, in accordance with a further implementation, a screen assembly 400 of FIG. 11 may be used in place of the screen assemblies 40 and 300. Referring to FIG. 11, in general, the screen assembly 400 has components similar to the screen assemblies 40 and 300, with the different elements being denoted by different reference numerals. In particular, unlike the screen assembly 350, the screen assembly 400 has the same shroud expanding tubes 120 as the screen assembly 40. In this manner, the shroud expanding tubes 120 of the screen assembly 400 do not contain rupture discs, as the tubes 120 are not used for purposes of installing the gravel pack inside the shroud 114. Instead, in addition to the shroud expanding tubes 120, the screen assembly 400 includes longitudinally extending (along the base pipe 100) gravel packing shunt tubes 410 for purposes of communicating gravel packing slurry downhole and depositing the gravel pack inside the annular space 117. Therefore, for this implementation, the shroud expanding tubes 120 may be first radially expanded by pressurizing the interior spaces of the tubes 120 (with a pumped fluid, for example) and thereafter, the pressurized state of the shroud expanding tubes may be refined using check valves, sleeves, and so forth, as disclosed herein. Next, in a subsequently phase, a gravel packing operation is performed via the shunt tubes 410 for purposes of depositing the gravel pack inside the shroud 114.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. A screen assembly usable with a well, comprising:
a base pipe;
filtering media disposed outside of the base pipe;
a shroud disposed outside of the base pipe; and
tubes disposed between the filtering media and the shroud and longitudinally extending along the base pipe, the tubes being adapted to be pressurized, thereby radially expanding the tubes to radially expand the shroud; wherein the tubes comprise gravel packing shunt tubes; and
at least one rupture disc disposed on at least one of the tubes to allow a pressurization of the at least one tube to cause radial expansion of the at least one tube and be subsequently breached to allow a gravel packing slurry to be communicated into an annular region outside of the tube after radial expansion of the shroud.

2. The assembly of claim 1, further comprising a screen disposed between the tubes and the base pipe.

3. The assembly of claim 2, wherein the screen comprises a wire-wrapped screen.

4. The assembly of claim 2, further comprising ribs to longitudinally extend between the base pipe and the screen.

5. The assembly of claim 1, wherein at least one of the tubes is adapted to be run into the well in a collapsed state to reduce an outer profile of the assembly.

6. The assembly of claim 1, further comprising at least one valve to retain pressure in at least one of the tubes after radial expansion of the shroud.

7. The assembly of claim 1, further comprising at least one additional tube to communicate a gravel packing slurry into the well.

8. A method usable with a well, comprising:
running an assembly comprising a base pipe, a shroud outside of the base pipe and tubes disposed between the base pipe and the shroud in the well;
expanding the shroud, wherein expanding the shroud comprises pressurizing the tubes to radially expand the tubes to radially expand the shroud; and
installing a gravel pack inside the shroud.

9. The method of claim 8, wherein running the assembly into the well comprises running a screen disposed between the tubes and the base pipe.

10. The method of claim 8, wherein further comprising assembling the tubes in sections and connecting the sections using jumper tubes.

11. The method of claim 8, wherein the radially expanding tubes comprise gravel packing tubes, and radially expanding the shroud comprises radially expanding the gravel packing tubes using a fluid pressurization provided by communication of a gravel packing slurry.

12. The method of claim 8, further comprising gravel packing after the radial expansion of the shroud, comprising using tubes other than the tubes that are radially expanded to radially expand the shroud.

13. The method of claim 8, wherein radially expanding the shroud comprises running a tool inside the assembly to communicate fluid to the tubes.

14. A system usable with a well, comprising:
a tubing string; and
screen assemblies connected to the tubing string, at least one of the screen assemblies comprising:
a base pipe;
filtering media disposed outside of the base pipe;
a shroud disposed outside of the base pipe;
tubes disposed between the filtering media and the shroud and longitudinally extending along the base pipe, the tubes adapted to be pressurized to radially expand to radially expand the shroud;
wherein the tubes comprise gravel packing tubes; and at least one rupture disc disposed on at least one of the tubes to allow a pressurization of the at least one tube to cause radial expansion of the at least one tube and be subsequently breached to allow a gravel packing slurry to be communicated into an annular region outside of the tube after radial expansion of the shroud.

15. The system of claim 14, further comprising at least one additional tube to communicate a gravel packing slurry into the well.

16. The system of claim 14, wherein the filtering media disposed outside the base pipe comprises a screen radially disposed between the base pipe and the tubes, and the screen further comprises ribs disposed between the screen and the base pipe to support the screen.

* * * * *